US008038417B2

(12) United States Patent
Yamamoto et al.

(10) Patent No.: US 8,038,417 B2
(45) Date of Patent: Oct. 18, 2011

(54) ELECTRIC PUMP UNIT AND ELECTRIC OIL PUMP APPARATUS

(75) Inventors: Ikuo Yamamoto, Kashiwara (JP); Takatoshi Sakata, Yamatotakada (JP)

(73) Assignee: JTEKT Corporation, Osaka-shi (JP)

( * ) Notice: Subject to any disclaimer, the term of this patent is extended or adjusted under 35 U.S.C. 154(b) by 903 days.

(21) Appl. No.: 12/039,451

(22) Filed: Feb. 28, 2008

(65) Prior Publication Data

US 2008/0206078 A1 Aug. 28, 2008

(30) Foreign Application Priority Data

Feb. 28, 2007 (JP) ..... 2007-049857

(51) Int. Cl.
*F04B 49/24* (2006.01)
*F16K 15/02* (2006.01)

(52) U.S. Cl. ..... 417/310; 137/538; 137/540

(58) Field of Classification Search ..... 417/310; 137/538, 540

See application file for complete search history.

(56) References Cited

U.S. PATENT DOCUMENTS 2,883,934 A * 4/1959 Roosa ..... 137/102
3,574,489 A * 4/1971 Pierrat ..... 418/61.3
5,505,275 A 4/1996 Phillips
6,481,458 B2 * 11/2002 Hirano et al. ..... 137/538
6,709,245 B2 * 3/2004 Bachmann ..... 417/310

FOREIGN PATENT DOCUMENTS

| | | |
|---|---|---|
| EP | 1 705 378 A2 | 9/2006 |
| JP | 11-13641 | 1/1999 |
| JP | 2005-98507 | 4/2005 |
| JP | 2006-188968 | 7/2006 |
| WO | WO 98/26181 | 6/1998 |

* cited by examiner

*Primary Examiner* — Charles Freay
(74) *Attorney, Agent, or Firm* — Oblon, Spivak, McClelland, Maier & Neustadt, L.L.P.

(57) ABSTRACT

In an electric pump unit, communication between arcuate ports provided in correspondence with a discharge side and a suction side of an internal gear pump is selectively permitted and prohibited in correspondence with movement of a spool of a relief valve. If fluid pressure at the discharge side of the internal gear pump becomes greater than or equal to a predetermined value, the spool moves across an inner arc of one of the arcuate ports corresponding to the suction side of the internal gear pump and from a position at which the spool prohibits the communication between the arcuate ports to a position at which the spool permits the communication. As the spool moves away from the position at which the spool blocks the communication between the arcuate ports, the opening degree of the relief valve changes in accordance with a downward convex curve.

5 Claims, 5 Drawing Sheets

ELECTRIC PUMP UNIT AND ELECTRIC OIL PUMP APPARATUS

CROSS-REFERENCE TO RELATED APPLICATIONS

This application is based on and claims priority from Japanese Patent Application No. 2007-049857 filed on Feb. 28, 2007, the entire contents of which are incorporated herein by reference.

BACKGROUND OF THE INVENTION

The present invention relates to an electric pump unit formed by unitizing an electric motor and an internal gear pump, which is driven by the electric motor to draw and discharge fluid such as oil, and to an electric oil pump apparatus having the electric pump unit.

As means to deal with global environmental problems, electric oil pump apparatuses are now broadly used in transmissions of vehicles such as automobiles. An electric oil pump apparatus compensates for a drop in hydraulic pressure in a transmission caused by stopping idling of a vehicle.

The electric oil pump apparatus includes an electric pump unit formed by unitizing (integrating) an electric motor and an internal gear pump, which is driven by the electric motor to draw and discharge oil (see Japanese Laid-Open Patent Publication No. 2006-188968). In the electric oil pump apparatus, the internal gear pump and the electric motor rotate about a common rotary shaft. This decreases the number of the components, reduces the size of the electric oil pump apparatus, and lowers the cost for manufacturing the apparatus.

In the electric oil pump apparatus, the hydraulic pressure at the discharge side of the internal gear pump may become higher than discharge pressure of the internal gear pump. In this state, an excessive load acts on the electric motor, which drives the internal gear pump. This may cause a loss of synchronism, or irreversible stopping of the electric motor. To solve this problem, a relief valve may be deployed in the electric pump unit to allow fluid to flow back to the suction side of the gear pump if the hydraulic pressure at the discharge side of the internal gear pump becomes greater than or equal to a predetermined value (see Japanese Laid-Open Patent Publication No. 11-13641). The relief valve has a spool (a valve body) that moves toward the suction side of the internal gear pump depending on the hydraulic pressure at the discharge side of the internal gear pump.

However, if such movement of the spool causes a relatively rapid increase of the opening degree of the relief valve, an excessive amount of oil flows back from the discharge side to the suction side of the internal gear pump. This decreases the volume efficiency of the internal gear pump (actual discharge amount of the internal gear pump/theoretical discharge amount of the internal gear pump). Thus, the flow rate of the oil may not satisfy the level required for the transmission of the automobile.

If the chamfer angle, or the angle between a slanted surface formed around a valve head of the spool and a wall surface defining a valve hole for receiving the relief valve, is reduced, the gradient of the linear relation between the movement amount of the spool and the flow rate of the oil becomes more gradual. This prevents the above-described decrease of the volume efficiency of the internal gear pump. However, the loss of synchronism of the electric motor, which is caused by the excessive hydraulic pressure produced at the discharge side of the internal gear pump, cannot be effectively avoided.

To solve this problem, a fluid discharge portion including a small annular opening and a large opening communicating with the small opening may be formed in the valve hole (see Japanese Laid-Open Patent Publication No. 2005-98507). This allows the oil to pass through the portion communicating the discharge side with the suction side of the internal gear pump at an improved passing characteristics.

However, since the fluid discharge portion has a complicated shape, machining the valve hole to form the fluid discharge portion is troublesome. Also, with reference to FIG. 1 of Japanese Laid-Open Patent Publication No. 2005-98507, for example, the relief valve is provided between a discharge port and a suction port, which are at a position spaced from the internal gear pump and extend in complicated manners. This complicates the structure of the electric oil pump apparatus and increases the number of the components of the electric oil pump apparatus. This technique thus cannot meet a recent requirement in a component of an automobile, which is decreasing the size and the weight of the components.

SUMMARY OF THE INVENTION

Accordingly, it is an objective of the present invention to provide an electric pump unit that prevents loss of synchronism of an electric motor without complicating the structure of the electric pump unit or decreasing the volume efficiency of an internal gear pump, and an electric oil pump apparatus including the electric pump unit.

To achieve the foregoing and other objectives and in accordance with a first aspect of the present invention, an electric pump unit including an electric motor, an internal gear pump, arcuate ports, and a relief valve is provided. The internal gear pump has an inner rotor and an outer rotor. The internal gear pump is driven by the electric motor to draw and discharge fluid. The arcuate ports are arranged in correspondence with a discharge side and a suction side of the internal gear pump. The relief valve has a spool received in a valve hole that allows communication between the arcuate ports. The communication between the arcuate ports is selectively permitted and prohibited by changing an opening degree of the relief valve in correspondence with movement of the spool in the valve hole. When a fluid pressure at the discharge side of the internal gear pump becomes greater than or equal to a predetermined value, the spool of the relief valve moves across an inner arc of one of the arcuate ports that corresponds to the suction side of the internal gear pump and from a position at which the spool prohibits the communication between the arcuate ports to a position at which the spool permits the communication between the arcuate ports, thereby causing a backflow of fluid from the discharge side to the suction side of the internal gear pump. The opening degree of the relief valve increases in accordance with a downward convex curve as the spool moves away from the position at which the spool prohibits the communication between the arcuate ports.

In accordance with a second aspect of the present invention, an electric oil pump apparatus that compensates for a drop in a hydraulic pressure of a transmission caused by stopping idling of a vehicle is provided. The electric oil pump apparatus includes the electric pump unit according to the above first aspect of the present invention.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

An embodiment of the present invention will now be described with reference to FIGS. 1 to 5C.

Figure 1:
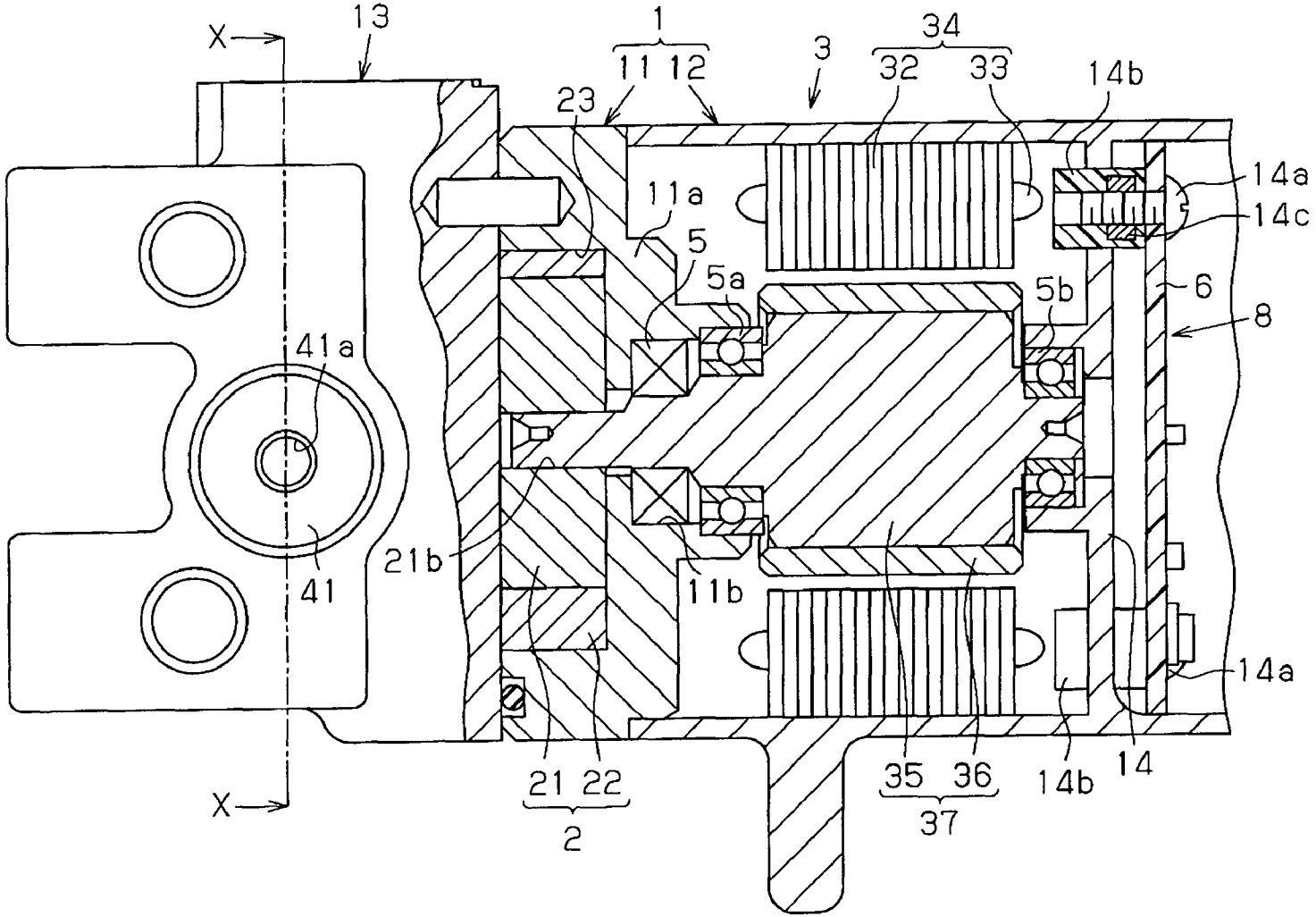
FIG. 1 is an axial cross-sectional view showing an electric pump unit according to one embodiment of the present invention.

An electric pump unit according to the present embodiment of the invention is used in an electric oil pump apparatus that compensates for a drop in hydraulic pressure in the transmission caused by stopping idling. As shown in FIG. 1, the electric pump unit includes a housing body 1, an internal gear pump 2, and an electric motor 3. The internal gear pump 2 is accommodated in the housing body 1 and draws and discharges oil. The electric motor 3 is also received in the housing body 1 to drive the internal gear pump 2.

The housing body 1 includes a pump housing 11 and a motor housing 12, which are provided as an integral body. The interior of the housing body 1 is partitioned by a bottom plate 11*a* of the pump housing 11.

The internal gear pump 2, which is provided in the pump housing 11, includes an inner rotor 21 and an outer rotor 22, each having a trochoidal tooth form. The outer rotor 22 is internally meshed with the inner rotor 21 in a state eccentric with respect to the inner rotor 21. The internal gear pump 2 is a trochoid pump, and draws and discharges oil through rotation of the inner and outer rotors 21, 22. An internal space 23 of the pump housing 11 accommodating the inner rotor 21 and the outer rotor 22 is closed by a pump plate 13.

The electric motor 3, which is arranged in the motor housing 12, has a rotor core 35 having a distal end passed through a through hole 21*b* of the inner rotor 21 to support the inner rotor 21 of the internal gear pump 2. The inner rotor 21 rotates integrally with the rotor core 35 of the electric motor 3 to drive the internal gear pump 2. A through hole 11*b* is formed substantially at the center of the bottom plate 11*a* of the pump housing 11 to pass the distal end of the rotor core 35 through the through hole 21*b* of the inner rotor 21. An oil seal 5 is arranged around the through hole 11*b* in the surface of the bottom plate 11*a* of the pump housing 11 facing the electric motor 3. This structure prevents oil from oozing from the internal space 23 of the pump housing 11 to the interior of the motor housing 12.

The electric motor 3 has a stator 34 and a cylindrical magnet 36, which are arranged around the rotor core 35, in addition to the rotor core 35. The stator 34 is formed by winding a coil 33 around a stator core 32 having a plurality of teeth with a non-illustrated insulator formed of insulating material such as resin in between. The magnet 36 is fixed to the outer circumference of the rotor core 35. The rotor core 35 and the magnet 36 constitute a motor rotor 37. The rotor core 35 is rotatably supported by the housing body 1 with a first ball bearing 5*a* provided in the bottom plate 11*a* of the pump housing 11 and a second ball bearing 5*b* arranged in a bottom plate 14 of the motor housing 12.

The interior of the motor housing 12 is divided into a first portion accommodating the electric motor 3 and a second portion accommodating a circuit substrate 6 by the bottom plate 14. The circuit substrate 6 is used to control operation of the electric motor 3. The circuit substrate 6 is secured to the bottom plate 14 by threading screws 14*a* into nuts 14*c*, which are embedded in corresponding resin portions 14*b* fixedly engaged with the bottom plate 14 of the motor housing 12. A controller 8 formed by electronic components such as a coil, a capacitor, and an IC is mounted on the circuit substrate 6.

Figure 2:
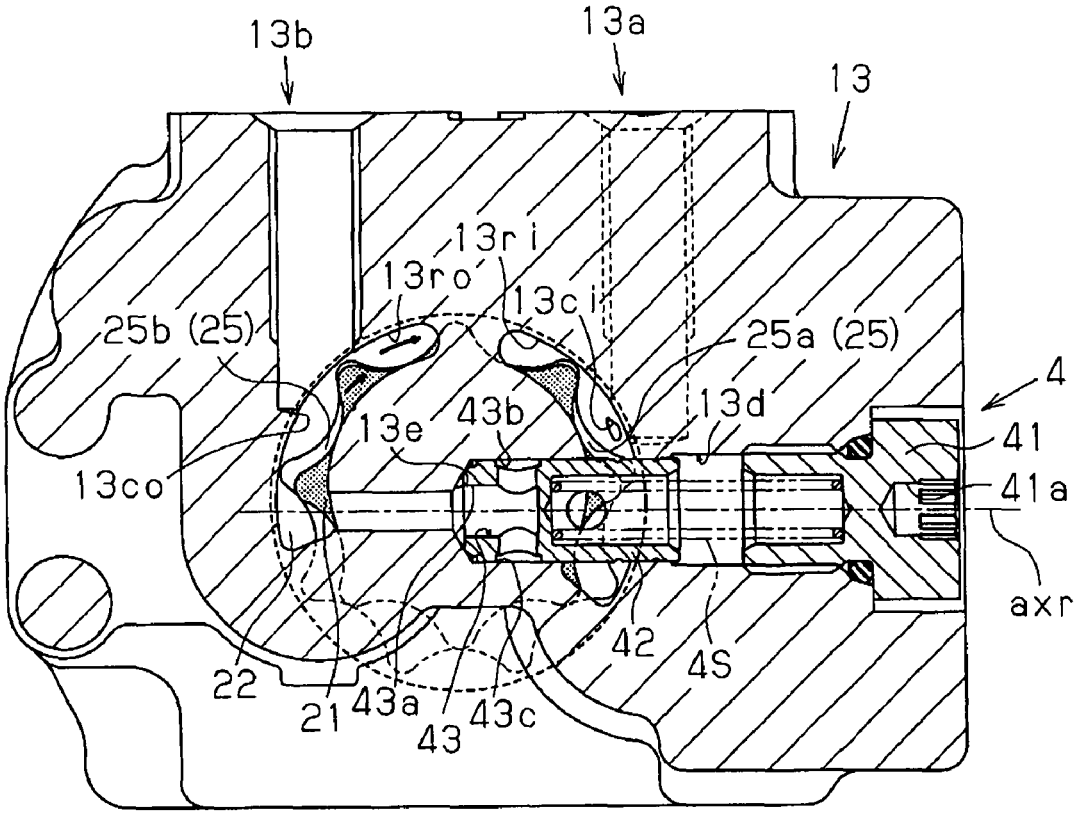
FIG. 2 is a cross-sectional view showing the electric pump unit taken along line X-X of FIG. 1.

With reference to FIG. 2, a pump chamber 25 is defined between the inner rotor 21 and the outer rotor 22. A suction port 13*a* and a discharge port 13*b*, which are defined in the pump plate 13, communicate with the pump chamber 25. As the inner rotor 21 and the outer rotor 22 rotate in the direction represented by the arrows of FIG. 2, the pressure in the zone of the pump chamber 25 communicating with the suction port 13*a* becomes lower than the pressure in the zone of the pump chamber 25 communicating with the discharge port 13*b*. In other words, the zone of the pump chamber 25 communicating with the suction port 13*a* corresponds to a low pressure zone 25*a*. The zone of the pump chamber 25 communicating with the discharge port 13*b* corresponds to a high pressure zone 25*b*.

As illustrated in FIG. 2, an arcuate port 13*ri* and an arcuate port 13*ro*, which communicate with the low pressure zone 25*a* and the high pressure zone 25*b*, respectively, are defined in the pump plate 13. The arcuate port 13*ri* extends along the low pressure zone 25*a* of the pump chamber 25 and the arcuate port 13*ro* extends along the high pressure zone 25*b* of the pump chamber 25. The arcuate ports 13*ri*, 13*ro* extend through the pump plate 13 in the direction of the thickness of the pump plate 13 (see FIG. 3). The suction port 13*a* communicates with the arcuate port 13*ri* through a communication bore 13*ci* and the discharge port 13*b* communicates with the arcuate port 13*ro* through a communication bore 13*co*.

Figure 3:
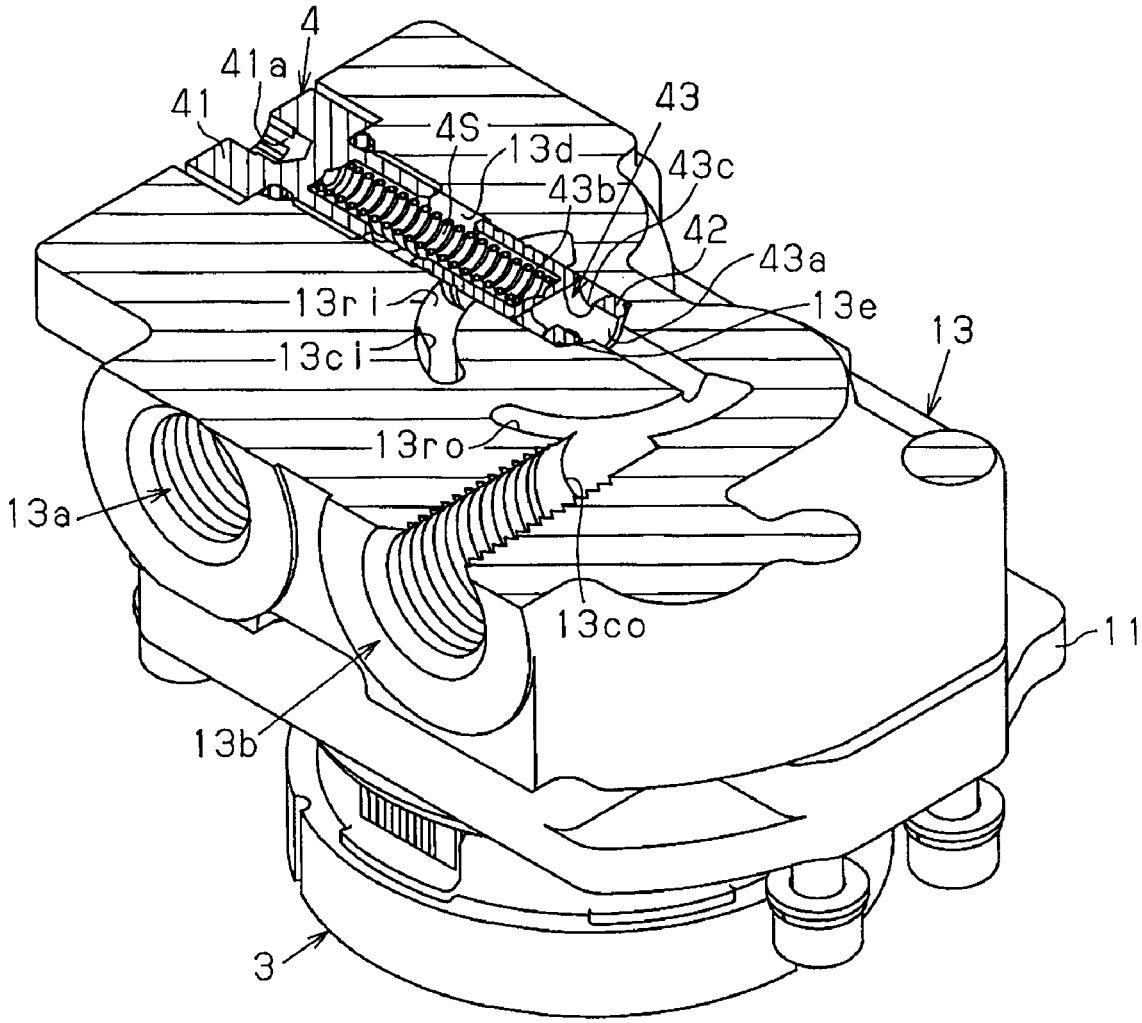
FIG. 3 is a perspective cross-sectional view showing a main portion of the electric pump unit shown in FIG. 1.

With reference to FIGS. 2 and 3, a valve hole 13*d* having a step 13*e* is provided in the pump plate 13. The valve hole 13*d* extends along an axis axr of FIG. 2 and communicates with lower sections of the arcuate ports 13*ri*, 13*ro*.

A relief valve 4 is accommodated in the valve hole 13*d*, as illustrated in FIGS. 2 and 3. When the hydraulic pressure (the fluid pressure) in the high pressure zone 25*b* of the pump chamber 25 becomes greater than or equal to a predetermined value (in the illustrated embodiment, 0.45 MPa), the relief valve 4 operates to cause a backflow of oil from the high pressure zone 25*b* (the discharge side of the internal gear pump 2) to the low pressure zone 25*a* (the suction side of the internal gear pump 2).

The relief valve 4 has an adjustment screw 41, a spool 42, and a spring 4*s*, which is arranged between the adjustment screw 41 and the spool 42. Both ends of the spring 4*s* are fitted into the inner sides of the adjustment screw 41 and the spool 42, which each have a lidded cylindrical shape, and fixed to the adjustment screw 41 and the spool 42. The spool 42 is capable of changing its position by reciprocating along the axis axr in the valve hole 13*d*.

The spool 42 has a communication bore 43 through which the discharge side of the internal gear pump 2 communicates with the suction side. The communication bore 43 has a distal opening 43*a* and a pair of side openings 43*b*, 43*c*. The oil flows from the discharge side of the internal gear pump 2 to the communication bore 43 through the distal opening 43*a*. The oil then flows out toward the suction side of the internal gear pump 2 through the side openings 43*b*, 43*c*. The communication bore 43 has a circular cross-sectional shape.

A manipulating portion 41*a*, with which a tool such as a screw driver can be engaged, is formed at the rear end of the adjustment screw 41 (see FIG. 1). The screw driver is engaged with the manipulating portion 41*a* to rotate the adjustment screw 41. This moves the adjustment screw 41 along the axis axr and forward and backward in the valve hole 13*d*. In this manner, the spool 42 is adjusted to the position corresponding to the maximally contracted state of the spring 4*s*.

The electric pump unit of the illustrated embodiment, which is configured as described above, operates in the following manner. Specifically, as the motor rotor 37 of the electric motor 3 rotates, the inner rotor 21 and the outer rotor 22 of the internal gear pump 2 rotate about the respective rotational axes. This increases the volume of the low pressure zone 25*a* of the pump chamber 25 and decreases the pressure in the low pressure zone 25*a*. At the same time, the volume of the high pressure zone 25*b* of the pump chamber 25 decreases and the pressure in the high pressure zone 25*b* rises. As a result, the oil is drawn from the exterior to the low pressure zone 25*a* through the suction port 13*a*, the communication bore 13*ci*, and the arcuate port 13*ri*. The oil is then sent through the pump chamber 25 toward the high pressure zone 25*b* through rotation of the inner rotor 21 and the outer rotor 22. Eventually, the oil is discharged to the exterior through the arcuate port 13*ro*, the communication bore 13*co*, and the discharge port 13*b*.

Figure 4A:
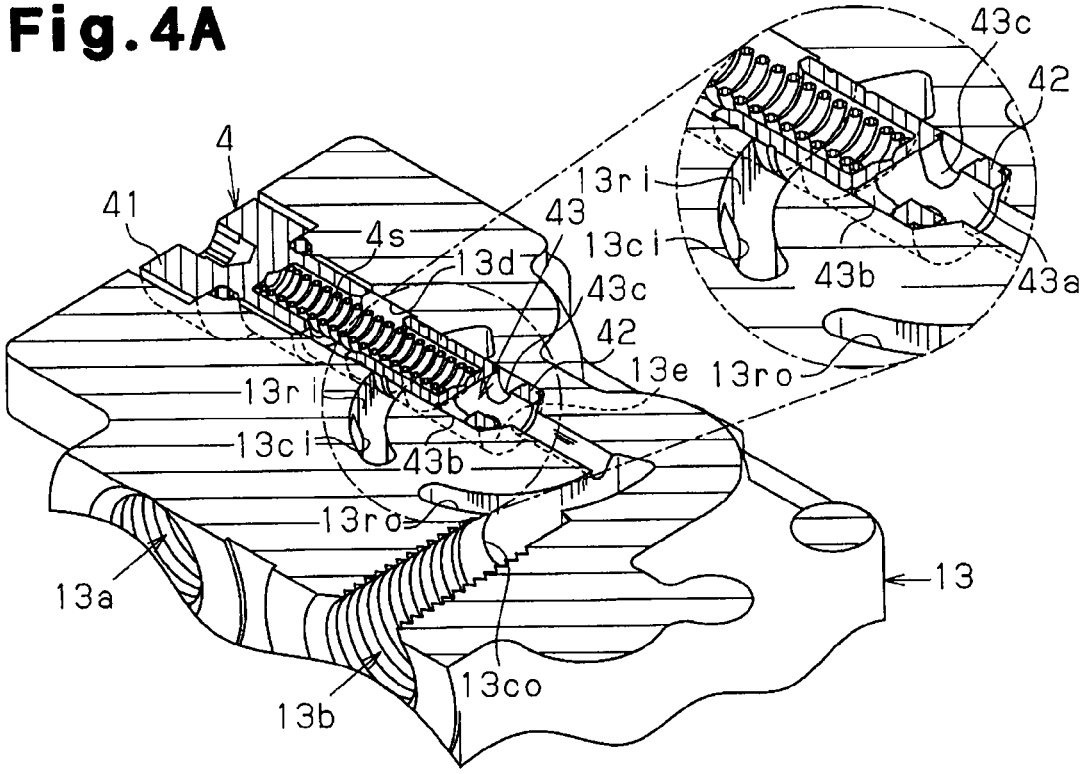
FIGS. 4A and 4B are perspective cross-sectional views showing the main portion of the electric pump unit shown in FIG. 1, illustrating an operation of the electric pump unit.
Figure 5A:
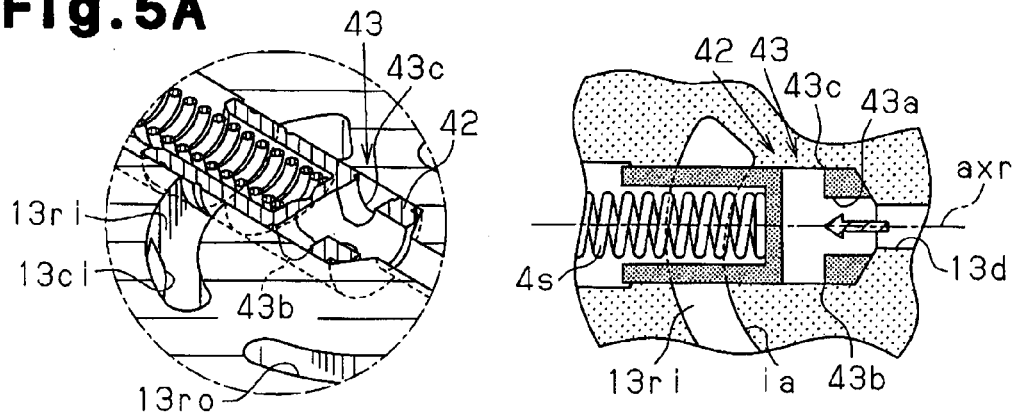
FIG. 5A is a perspective cross-sectional view showing a part of the main portion of the electric pump unit shown in FIG. 1 in correspondence with FIG. 4A, with a cross-sectional view of the part.

When the hydraulic pressure in the high pressure zone 25*b* of the pump chamber 25 is less than 0.45 MPa (P0<0.45 MPa), the spool 42 of the relief valve 4 is held in contact with the step 13*e* of the valve hole 13*d* by the urging force of the spring 4*s*, as illustrated in FIGS. 4A and 5A. In this state, the communication bore 43 of the spool 42 is disconnected from the arcuate port 13*ri*, which is located at the suction side of the internal gear pump 2. This prevents the communication bore 43 of the spool 42 from permitting communication between the arcuate port 13*ri* and the arcuate port 13*ro*.

Figure 4B:
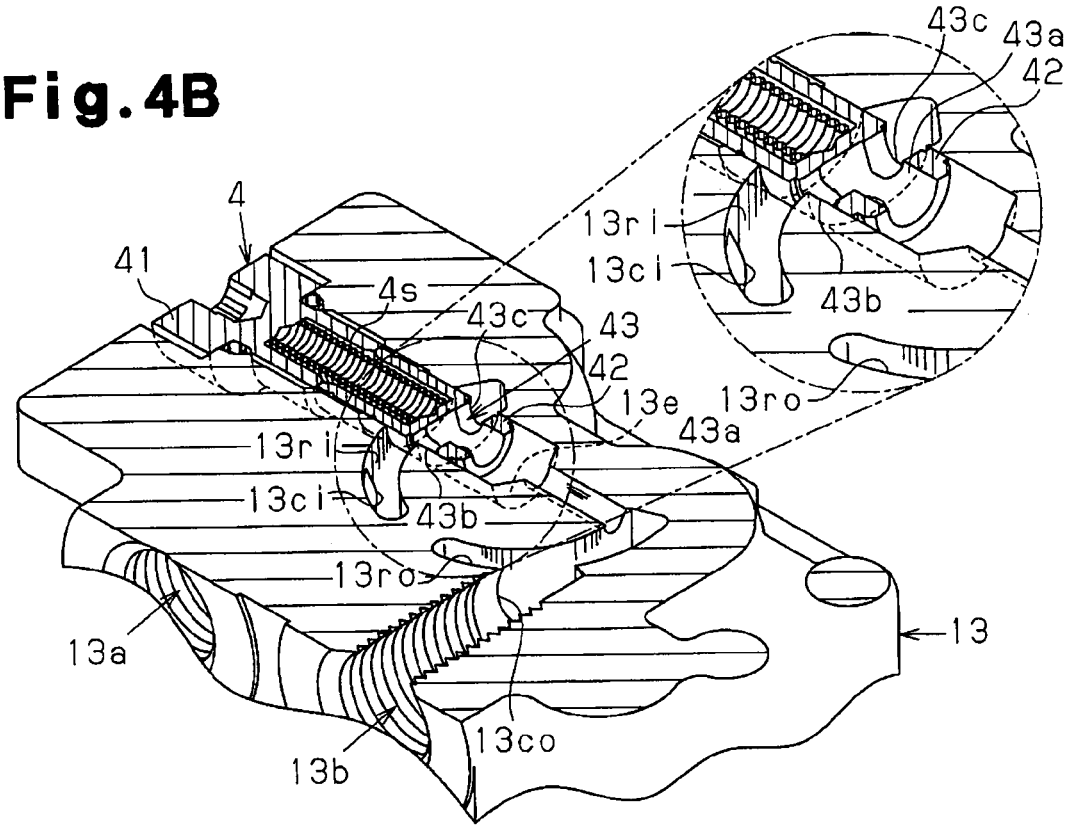
Figure 5B:
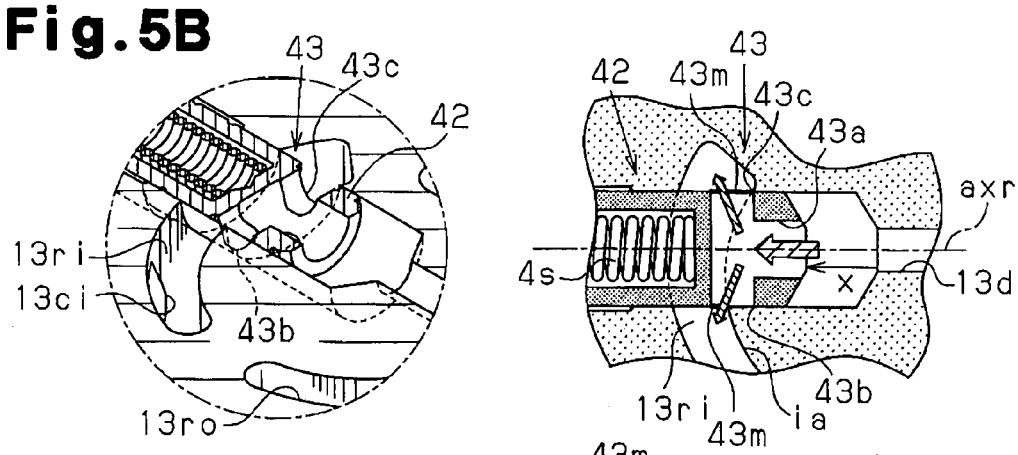
FIG. 5B is a perspective cross-sectional view showing the part of the main portion of the electric pump unit shown in FIG. 1 in correspondence with FIG. 4B, with a cross-sectional view of the part.

If the hydraulic pressure in the high pressure zone 25*b* of the pump chamber 25 becomes greater than or equal to 0.45 MPa (P≧0.45 MPa), such rise in the hydraulic pressure separates the spool 42 from the step 13*e* of the valve hole 13*d* along the axis axr against the urging force of the spring 4*s*, as illustrated in FIGS. 4B and 5B. The communication bore 43 of the spool 42 thus communicates with the arcuate port 13*ri* through the openings 43*b*, 43*c*. As a result, some of the oil flows back from the arcuate port 13*ro* to the arcuate port 13*ri* and the hydraulic pressure in the high pressure zone 25*b* drops.

Figure 5C:
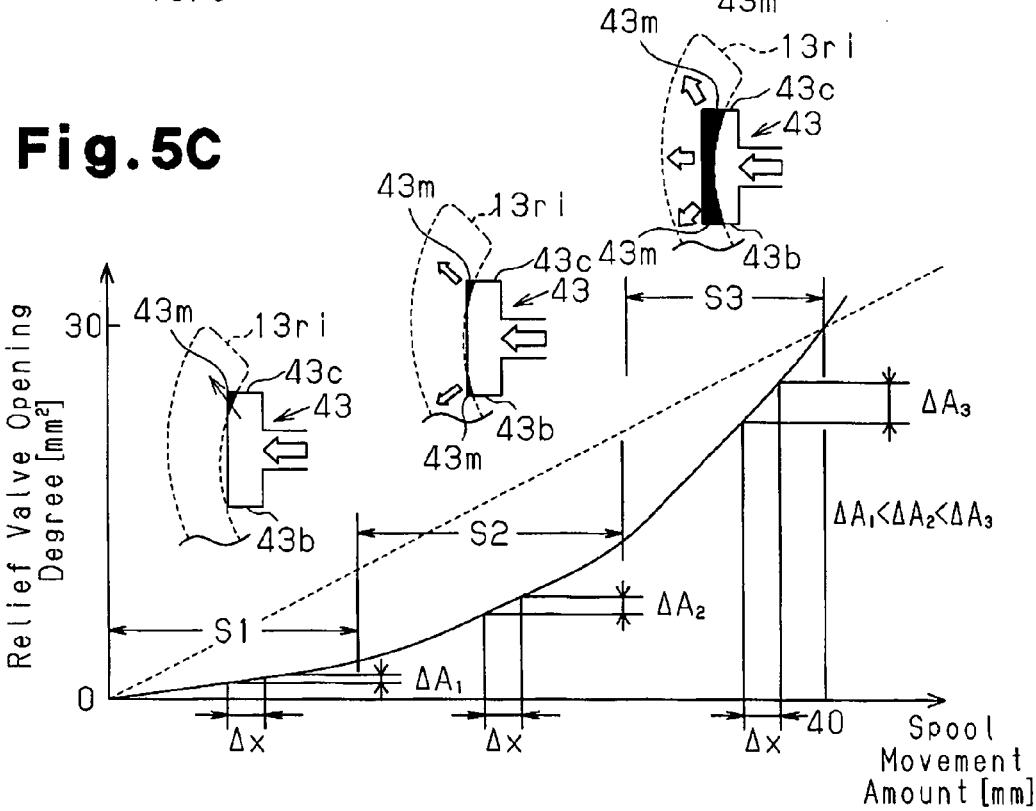
FIG. 5C is a graph representing the opening degree of a relief valve versus the movement amount of a relief valve of the electric pump unit shown in FIG. 1.

In other words, with reference to FIGS. 5A, 5B, and 5C, if the hydraulic pressure in the high pressure zone 25*b* of the pump chamber 25 becomes greater than or equal to 0.45 MPa, the spool 42 separates from the position at which the spool 42 contacts the step 13*e* of the valve hole 13*d*, and moves across an inner arc ia of the arcuate port 13*ri*, which is located at the suction side of the internal gear pump 2. This permits communication between the arcuate port 13*ri* and the valve hole 13*d* through the communication bore 43 of the spool 42. The total communication area of a communicating portion 43*m* of the arcuate port 13*ri* and the valve hole 13*d*, which is brought about by the communication bore 43, or an opening degree of the relief valve 4, increases in accordance with a downward-convex curve shown by a solid line in FIG. 5C as the spool 42 moves. Specifically, as illustrated in FIG. 5C, a portion of the opening 43*c* of the communication bore 43 first communicates with the arcuate port 13*ri*. Then, as the movement amount of the spool 42 increases, a portion of the opening 43*b* of the communication bore 43 communicates with the arcuate port 13*ri*, in addition to the opening 43*c*. In FIG. 5C, the period S1 corresponds to the period from when the portion of the opening 43*c* starts to communicate with the arcuate port 13*ri* to when the portion of the opening 43*b* starts to communicate with the arcuate port 13*ri*. In the period S1, the opening degree of the relief valve 4 increases relatively slowly as the movement amount of the spool 42 increases. In other words, in the period S1, the amount of the oil flowing back from the discharge side to the suction side of the internal gear pump 2 increases relatively slowly.

When the portion of the opening 43*b*, in addition to the portion of the opening 43*c*, starts to communicate with the arcuate port 13*ri*, the opening degree of the relief valve 4 starts to increase slightly more quickly as the movement amount of the spool 42 increases. Then, when the movement amount of the spool 42 increases to the point at which the opening 43*c* and the opening 43*b* partially face each other in the arcuate port 13*ri*, the opening degree of the relief valve 4 starts to increase further more rapidly as the movement amount of the spool 42 increases. In FIG. 5C, the period S2 represents the period from when the portion of the opening 43*b*, in addition to the portion of the opening 43*c*, starts to communicate with the arcuate port 13*ri* to when the openings 43*c*, 43*b* start to partially face each other in the arcuate port 13*ri*. In the period S2, the amount of the oil flowing back from the discharge side to the suction side of the internal gear pump 2 increases slightly quickly. In FIG. 5C, the period S3 represents the period after the openings 43*b*, 43*c* start to partially face each other in the arcuate port 13*ri*. In the period S3, the amount of the oil flowing back from the discharge side to the suction side of the internal gear pump 2 increases further more quickly.

Increases $\Delta A_1$, $\Delta A_2$, $\Delta A_3$ of the opening degree of the relief valve 4 per unit movement amount $\Delta x$ of the spool 42 of the periods S1, S2, S3, respectively, of FIG. 5C satisfy the following expression: $\Delta A_1<\Delta A_2<\Delta A_3$.

In the illustrated embodiment, the communication bore 43 of the spool 42 has the circular cross-sectional shape. Thus, compared to a case in which the communication bore 43 has a rectangular cross-sectional shape, the increase $\Delta A_1$ of the opening degree of the relief valve 4 per unit movement amount $\Delta x$ of the spool 42 in the period S1 of FIG. 5C is small. In other words, in the period S1, the passing characteristics of the oil is improved.

If the electric motor 3 is continuously operated with the hydraulic pressure at the discharge side of the internal gear pump 2 maintained at a value greater than or equal to 0.45 MPa, excessive load causes the electric motor 3 to eventually stop in an irreversible manner. That is, a loss of synchronism occurs. However, in the illustrated embodiment, if the hydraulic pressure at the discharge side of the internal gear pump 2 increases to a value greater than or equal to 0.45 MPa, the relief valve 4 operates to cause a backflow of oil from the discharge side to the suction side of the internal gear pump 2. This prevents the loss of the synchronism of the electric motor 3.

A straight line shown by a broken line in FIG. 5C represents the relationship between the opening degree of a relief valve and the movement amount of a spool of another internal gear pump. The internal gear pump has a reduced chamfer angle to suppress lowering of the volume efficiency of the internal gear pump. Comparison between the straight line shown by a broken line and the curve shown by a solid line clearly shows that the opening degree of the relief valve 4 of the internal gear pump 2 according to the illustrated embodiment increases slowly as the movement amount of the spool 42 increases as long as the movement amount of the spool 42 is comparatively small (particularly, in the period S1 in FIG. 5C).

The illustrated embodiment has the following advantages.

If the hydraulic pressure at the discharge side of the internal gear pump 2 becomes greater than or equal to 0.45 MPa, the spool 42 of the relief valve 4 moves to cause the oil to flow back from the discharge side to the suction side of the internal gear pump 2. In this manner, the loss of synchronism of the electric motor 3, which is caused by an excessive hydraulic pressure at the discharge side of the internal gear pump 2, is avoided.

In the illustrated embodiment, as the spool 42 moves away from the position at which the spool 42 contacts the step 13*e* of the valve hole 13*d*, the opening degree of the relief valve 4 increases in accordance with a downward convex curve. Thus, as long as the movement amount of the spool 42 is relatively small (particularly, in the period S1 of FIG. 5C), the opening degree of the relief valve 4 increases relatively slowly as the movement amount of the spool 42 increases. Accordingly, in this period, the volume efficiency of the internal gear pump 2 is prevented from being decreased by a rapid increase of the opening degree of the relief valve 4 in this period.

Although the electric pump unit of the illustrated embodiment has the components including the relief valve 4 in order to cause a backflow of the oil from the discharge side to the suction side of the internal gear pump 2, these components do not significantly complicate the structure of the electric pump unit. The manufacture of the electric pump unit is thus not complicated. Further, the cost for manufacturing the electric pump unit is prevented from significantly increasing.

The illustrated embodiment may be modified as follows.

In the illustrated embodiment, the communication bore 43 of the spool 42 has the distal opening 43*a* and the two side openings 43*b*, 43*c*. The oil flows from the discharge side of the internal gear pump 2 to the communication bore 43 through the distal opening 43*a*. The oil is then discharged toward the suction side of the internal gear pump 2 through the side openings 43*b*, 43*c*. However, the configuration of the communication bore 43 of the spool 42 is not restricted to this. Alternatively, the communication bore 43 may be omitted. Also in these cases, advantages substantially equivalent to those of the illustrated embodiment are obtained.

The arcuate ports 13*ri*, 13*ro* may be defined in a component such as the pump housing 11, other that the pump plate 13.

In the illustrated embodiment, the electric pump unit is used as an electric oil pump apparatus that compensates for a drop in the hydraulic pressure of the transmission caused by stopping idling of the automobile. However, the electric pump unit may be used in the automobile for other purposes. For example, the electric pump unit may be employed as a pump apparatus that assists the manipulation of a steering wheel of a vehicle such as an automobile. Alternatively, the electric pump unit may be used for purposes other than those involved in automobiles.

Instead of the trochoidal tooth form, the inner rotor 21 and the outer rotor 22 of the internal gear pump 2 may include other tooth forms such as a parachoid (registered trademark) tooth form or an involute tooth form.

The invention claimed is:

1. An electric pump unit comprising:

an electric motor;

an internal gear pump having an inner rotor and an outer rotor, the internal gear pump being driven by the electric motor to draw and discharge fluid;

arcuate ports arranged in correspondence with a discharge side and a suction side of the internal gear pump; and a relief valve having a spool received in a valve hole that allows communication between the arcuate ports, the communication between the arcuate ports being selectively permitted and prohibited by changing an opening degree of the relief valve in correspondence with movement of the spool in the valve hole, wherein, when a fluid pressure at the discharge side of the internal gear pump becomes greater than or equal to a predetermined value, the spool of the relief valve moves across an inner arc of one of the arcuate ports that corresponds to the suction side of the internal gear pump and from a position at which the spool prohibits the communication between the arcuate ports to a position at which the spool permits the communication between the arcuate ports, thereby causing a backflow of fluid from the discharge side to the suction side of the internal gear pump, and wherein the opening degree of the relief valve increases in accordance with a downward convex curve as the spool moves away from the position at which the spool prohibits the communication between the arcuate ports.

2. The electric pump unit according to claim 1, wherein the spool of the relief valve has a communication bore, and wherein, when the relief valve permits the communication between the arcuate ports, the arcuate ports communicate with each other through the communication bore.

3. The electric pump unit according to claim 2, wherein the communication bore of the spool has a circular cross-sectional shape.

4. The electric pump unit according to claim 1, wherein the inner rotor and the outer rotor of the internal gear pump each have a trochoidal tooth form.

5. An electric oil pump apparatus that compensates for a drop in a hydraulic pressure of a transmission caused by stopping idling of a vehicle, the electric oil pump apparatus comprising the electric pump unit according to claim 1.

* * * * *